US005442841A

United States Patent [19]

McLeod et al.

[11] Patent Number: 5,442,841

[45] Date of Patent: Aug. 22, 1995

[54] HOISERY TRIMMING APPARATUS

[75] Inventors: Daniel W. McLeod, Robbins; Peter A. Mahler, High Point, both of N.C.

[73] Assignee: Pam Trading Corporation, Greensboro, N.C.

[21] Appl. No.: 319,237

[22] Filed: Oct. 6, 1994

[51] Int. Cl.[6] ..... D06C 13/00; B26D 5/00; B65G 47/00; G65H 11/00

[52] U.S. Cl. ..... 26/7; 414/222; 83/364; 83/367; 198/345.2

[58] Field of Search ..... 26/7, 15; 112/304; 198/341, 345.2; 414/222; 83/364, 367

[56] References Cited

U.S. PATENT DOCUMENTS

| | | | |
|---|---|---|---|
| 2,705,827 | 4/1955 | Gamache | 26/7 |
| 2,979,802 | 4/1961 | Funchion et al. | 26/7 |
| 4,558,984 | 12/1985 | Garrett | 414/222 X |
| 4,596,505 | 6/1986 | Seelinger | 414/222 X |
| 4,704,792 | 11/1987 | Itagaki et al. | 414/222 X |
| 5,109,584 | 5/1992 | Irie et al. | 198/341 X |
| 5,299,693 | 4/1994 | Ubaldi et al. | 198/341 X |

*Primary Examiner*—John J. Calvert

[57] ABSTRACT

A hosiery trimming apparatus for trimming and removing loose yarn ends from articles of hosiery which comprises a frame carrying a bidirectional conveyor on which is received single or pairs of hosiery articles having loose yarn ends. The articles are moved in a first preselected direction until that direction is changed by a sensing means detecting the conveyed hosiery. The hosiery articles then move in the reverse direction until they engage a second sensing means which initiates a hosiery article clamping device and a conveyor pivoting means to move the conveyor and carried hosiery articles into engagement with a trimming device supported by the frame. The trimming device trims the loose yarn ends from the hosiery articles, and the conveyor is then returned to its original position and moves the carried hosiery articles in the original direction and off to a remote location.

14 Claims, 4 Drawing Sheets

HOISERY TRIMMING APPARATUS

BACKGROUND OF THE INVENTION

1. Field of the Invention

The present invention relates to conveyor and trimming systems and more particularly to a hosiery trimming apparatus for trimming and removing loose yarn ends from articles of hosiery.

2. Description of the Prior Art

After hosiery articles such as socks are made and dyed, they are boarded on a boarding frame. A typical boarding machine includes a rotatable platform which has upstanding boarding frames or forms onto which the socks are individually stretched for inspection by an operator. As the platform rotates away from the operator, the socks are moved first to a drying station and then to a removal station where they are automatically removed from the forms and deposited flat on a conveyor with the toe in a forward position. In the manufacture of hosiery articles such as socks, there are always loose ends of yarn extending upwardly from the welt or top end of each sock which must be trimmed at some stage in the production process. Trimming is usually done manually after the socks leave the boarding machine. Such manual trimming is accomplished by stacking a bundle of socks by hand and running an electric trimmer somewhat resembling an electric shaver across the top or welt end of the bundle by hand.

To date, no satisfactory machine has been utilized to accomplish the trimming operation. Since manually handling hosiery articles to accomplish the trimming operation is time consuming and therefore expensive, there is a need for automating this operational step to make sock manufacturing more efficient. The present invention is directed to that critical need.

OBJECTIVES AND SUMMARY OF THE INVENTION

It is an objective of the present invention to provide a new and improved hosiery trimming apparatus for trimming and removing loose yarn ends from articles of hosiery which has all of the advantages of prior art devices and more, and none of the disadvantages.

A further objective of the present invention is to provide a hosiery trimming apparatus of the type described that can be positioned to receive directly from the hosiery boarding machine single or pairs of hosiery articles without the need for manually unloading the boarding machine and loading the trimming apparatus.

Yet another objective of the present invention is to provide a trimming apparatus of the type described which can direct single or pairs of hosiery articles to a remote location after completing the yarn trimming operation.

Yet still another further objective of the present invention is to provide a trimming apparatus that is simple in construction, efficient in operation, and economical to fabricate and use.

These objectives and others which will become apparent as the description proceeds are obtained by mounting a bidirectional conveyor on a frame to cooperatively receive one or more articles of hosiery having loose yarn ends and moving those articles in a first preselected direction. A first sensing means detects the moving hosiery at a preselected location and activates a mechanism to reverse the directional movement of the conveyor and carried socks. A second sensing device detects the moving hosiery articles and activates a hosiery article clamping and conveyor pivoting means to move the conveyor and carried socks to a position in the proximity of a yarn trimming device. The loose yarn ends are trimmed from the hosiery articles and the conveyor is returned to its original position and moves in its original preselected direction so that the trimmed hosiery articles are carried to a remote location for packaging or other operations.

Thus there has been outlined, rather broadly, the more important features of the invention in order that the derailed description that follows may be better understood and in order that the present contribution to the art may be better appreciated. There are obviously additional features of the invention that will be described hereinafter and which will form the subject matter of the claims appended hereto. In this respect, before explaining several embodiments of the invention in detail, it is to be understood that the invention is not limited in its application to the details of construction and to the arrangement of the components set forth in the following description or illustrated in the drawings. The invention is capable of other embodiments and of being practiced and carried out in various ways.

It is also to be understood that the phraseology and terminology herein are for the purpose of description and should not be regarded as limiting in any respect. Those skilled in the art will appreciate the concept upon which this disclosure is based and that it may readily be utilized as a basis for designing other structures, methods and systems for carrying out the several purposes of this development. It is important that the claims be regarded as including such equivalent constructions insofar as they do not depart from the spirit and scope of the present invention.

BRIEF DESCRIPTION OF THE DRAWINGS

So that the manner in which the above-recited features, advantages and objectives of the invention, as well as others which will become apparent, are obtained and can be understood in detail, a more particular description of the invention briefly summarized above may be had by reference to the embodiment thereof which is illustrated in the appended drawings, which drawings form a part of this specification and wherein like characters of reference designate like parts throughout the several views. It is to be noted, however, that the appended drawings illustrate only a preferred and alternative embodiments of the invention and are therefore not to be considered limiting of its scope, as the invention may admit to additional equally effective embodiments.

Referring now to the drawings.

DESCRIPTION OF THE PREFERRED EMBODIMENT

Figure 1:
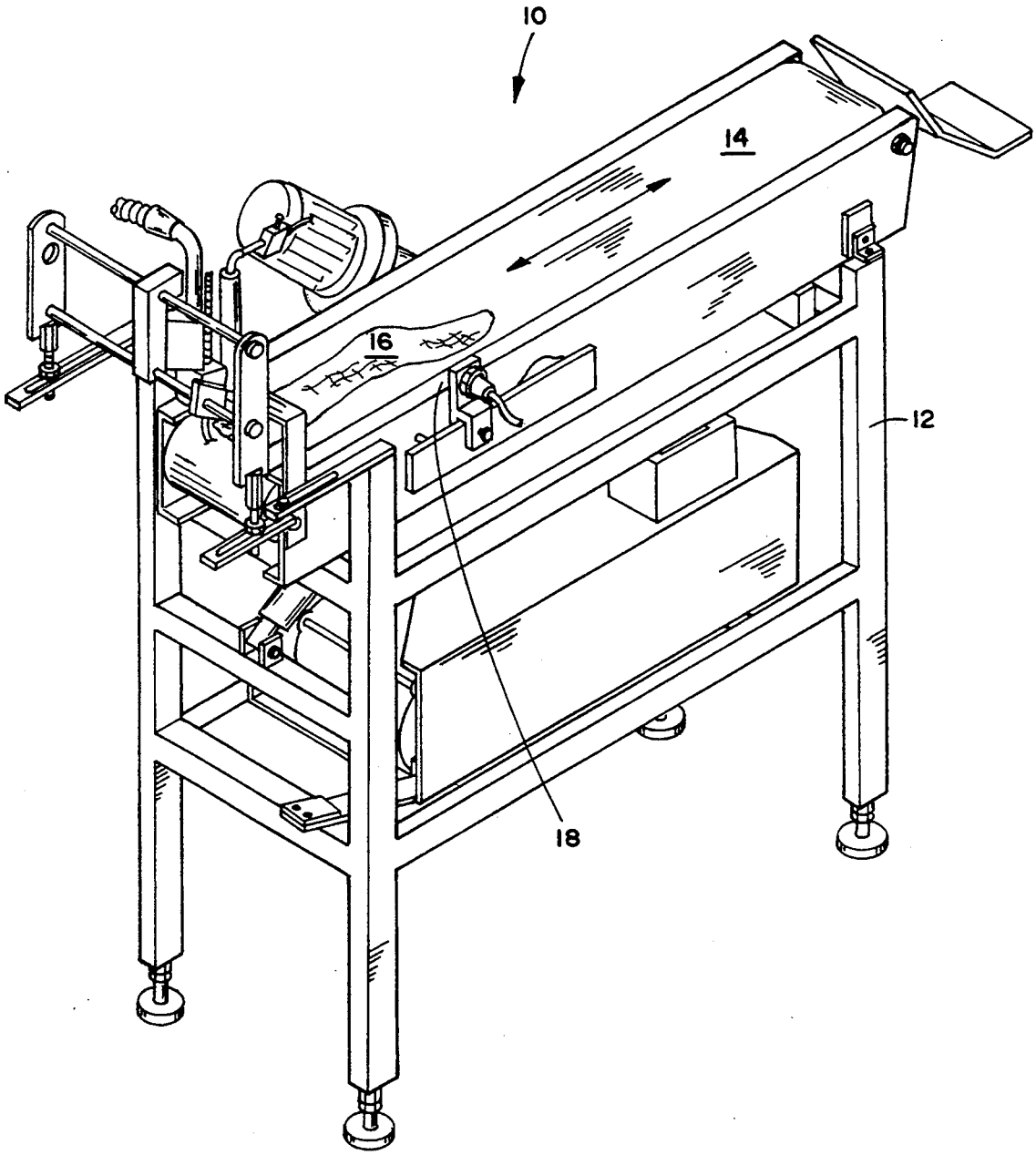
FIG. 1 is a perspective view of the hosiery trimming apparatus comprising the present invention showing a carried hosiery article on the bidirectional conveyor.
Figure 2:
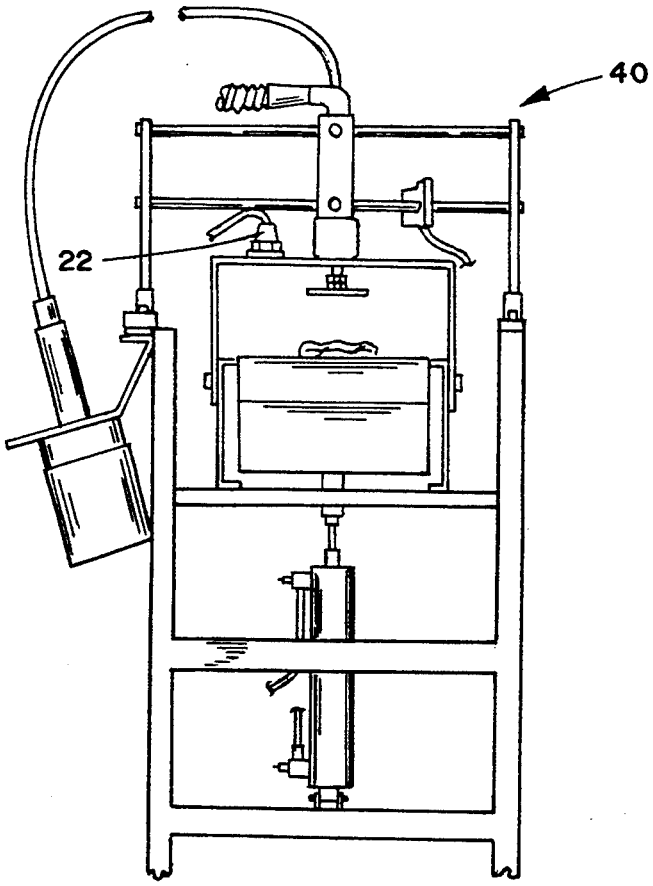
FIG. 2 is an end elevational and sectional view of the trimming apparatus shown in FIG. 1.
Figure 3:
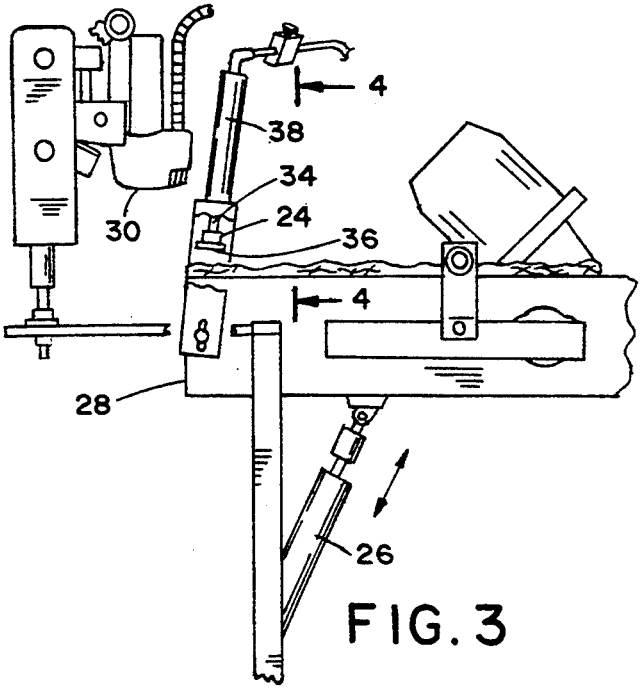
FIG. 3 is a side elevational and fragmentary view of the trimming and clamping devices of the present invention.
Figure 4:
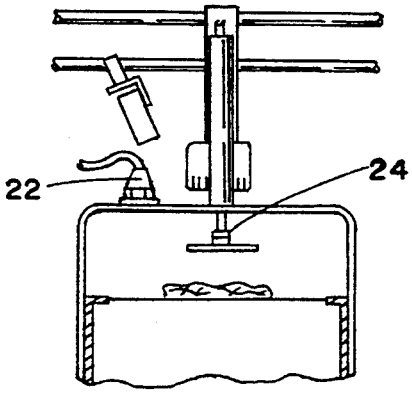
FIG. 4 is an end elevational and sectional view taken along the lines 4—4 of FIG. 3.
Figure 5:
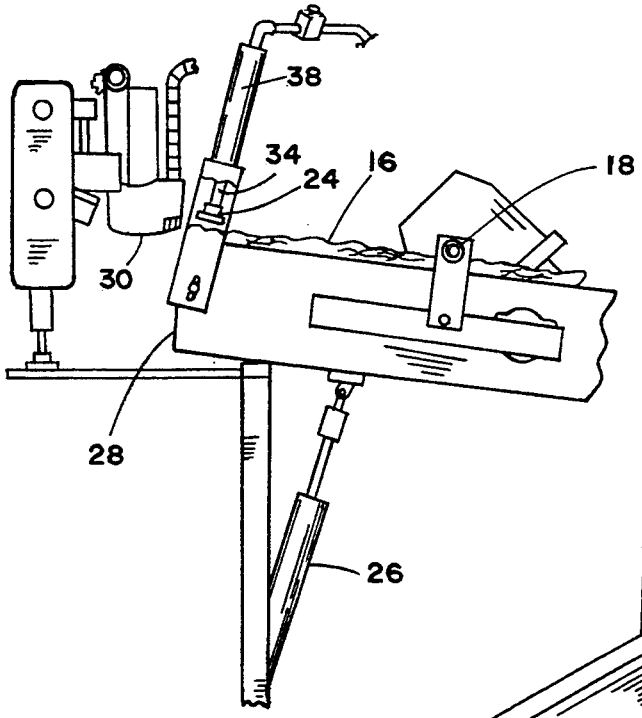
FIG. 5 is a side elevational and fragmentary view of the trimming and clamping devices of FIG. 3 when the conveyor is pivoted to a raised position and the hosiery article is exposed to the trimming device.
Figure 6:
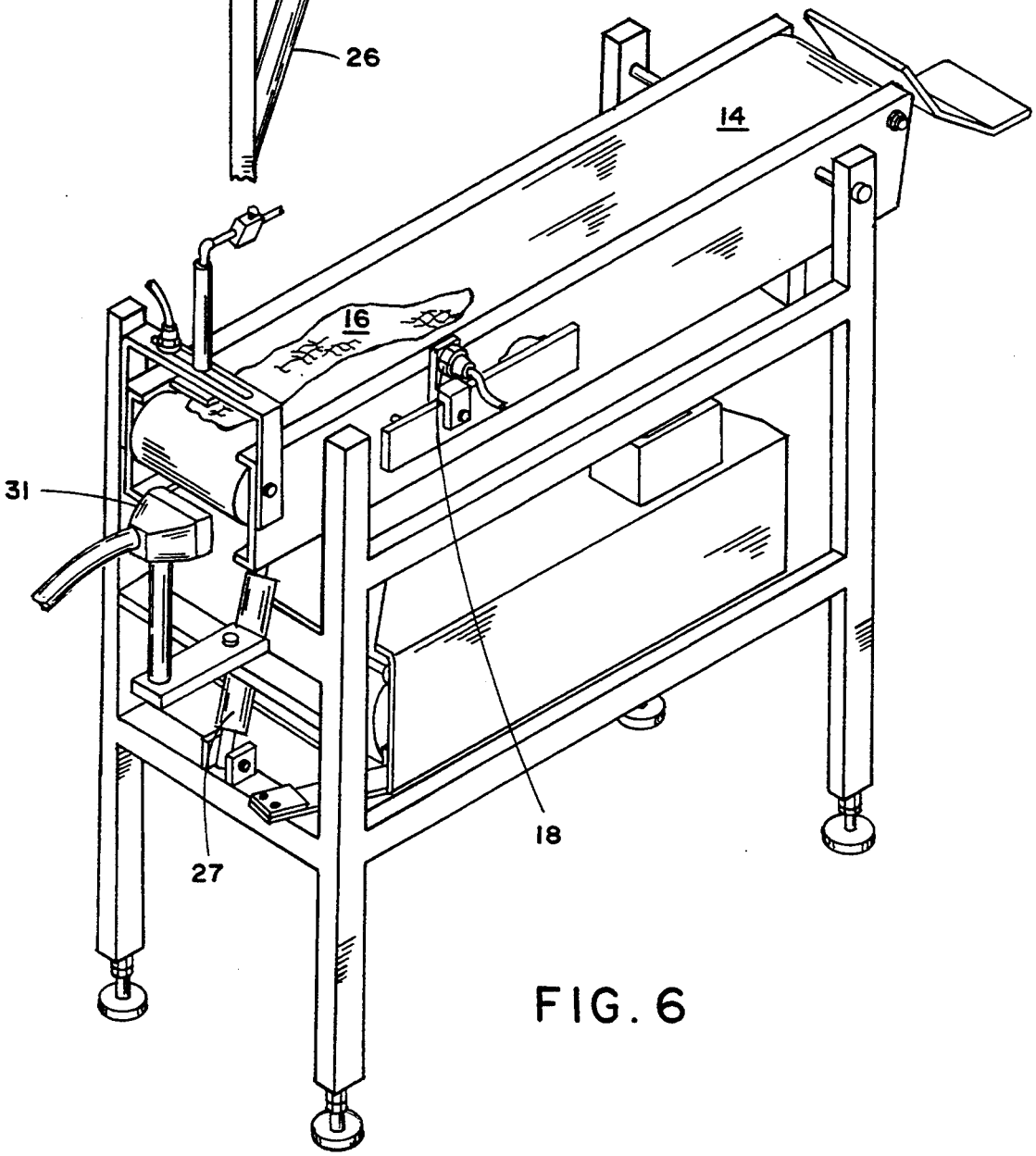
FIG. 6 is a perspective view of an alternate embodiment of the hosiery trimming apparatus comprising the present invention showing a carried hosiery article on the bidirectional conveyor.
Figure 7:
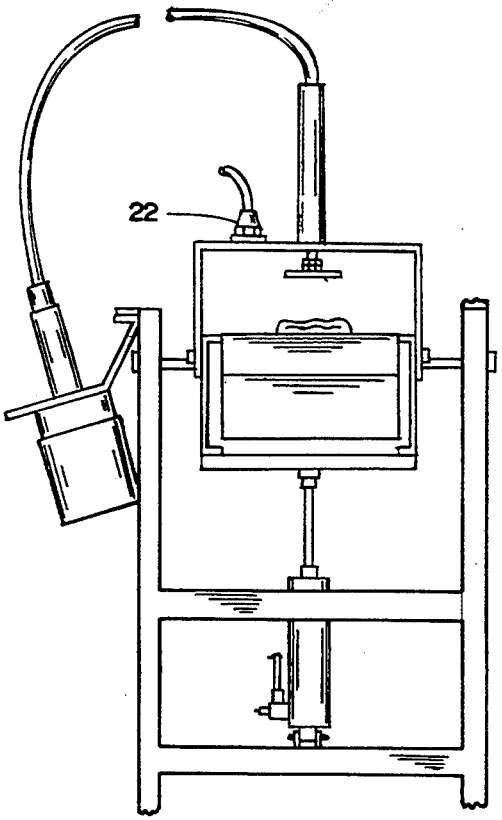
FIG. 7 is an end elevational and sectional view of the trimming apparatus shown in FIG. 6.
Figure 8:
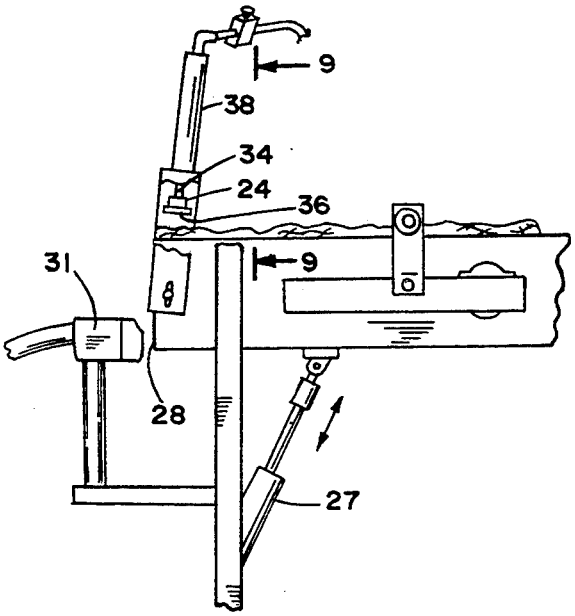
FIG. 8 is a side elevational and fragmentary view of the trimming apparatus shown in FIG. 6.
Figure 9:
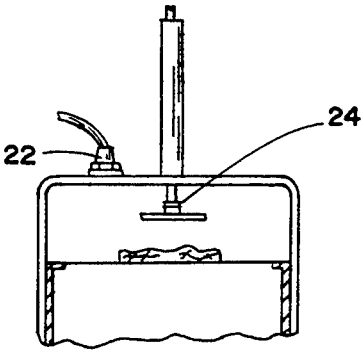
FIG. 9 is an end elevational and sectional view taken along lines 9—9 of FIG. 8.

Referring now to FIGS. 1–5 of the drawings and particularly to FIG. 1, the hosiery trimming apparatus shown generally as 10 comprising the present invention includes a frame 12 supporting a bidirectional conveyor 14 which receives one or more hosiery articles 16. As article 16 is moved to the right on conveyor 14, it is sensed by a sensor 18 positioned on frame 12 that activates a conveyor reversing device of a conventional design so that the directional movement of conveyor 14 is reversed and the carried hosiery articles 16 then move back toward their point of origin. A second sensing device 22 positioned proximate end 28 of conveyor 14 activates a hosiery clamping device 24 so that article 16 is secured to the surface of conveyor 14 and cannot be dislodged. At the same time, a conveyor pivoting device 26 operates to elevate or lift end 28 of conveyor 14 and position the welt end of article 16 in proximity with trimmer 30 as shown in FIG. 5. Trimmer 30 trims and removes the loose yarn ends from hosiery article 16 and evacuates them from the work area. After trimming is completed, device 26 operates to lower conveyor end 28 to its original position and initiate operation of the conveyor in the first preselected direction so that the trimmed hosiery articles 16 are moved off the conveyor to a remote location.

Figure 10:
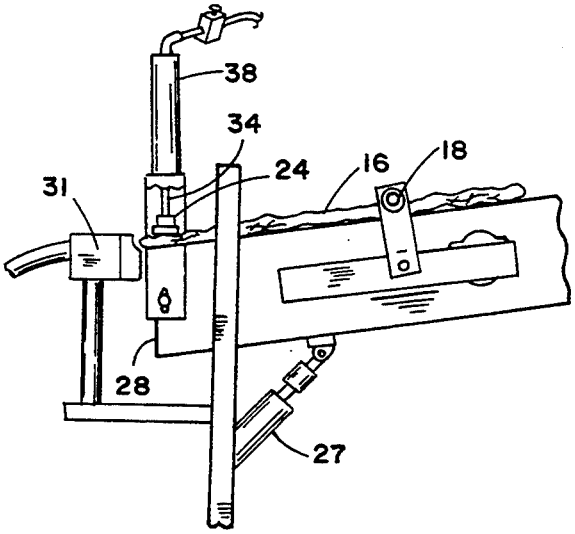
FIG. 10 is a side elevational and fragmentary view of the trimming and clamping devices of FIG. 8 when the conveyor is pivoted to a lowered position and the hosiery article is exposed to the trimming device.

Alternatively, as shown in FIGS. 6–10, it may be preferable to position trimmer 31 below the surface of conveyor 14 and provide pivoting device 27 which operates to depress or lower end 28 of conveyor 14 to position the welt end of article 16 in proximity with trimmer 31 as shown in FIG. 10. In such case, after trimming is completed, device 27 raises conveyor end 28 to its original position and initiates operation of the conveyor in the first preselected direction so that the trimmed hosiery articles 16 are moved off the conveyor to a remote location.

Sensing devices 18, 22 can be conventional photocells or other equally satisfactory conventional devices. A hydraulic cylinder works satisfactorily as the conveyor pivoting device 26 although air cylinders or solenoids can be effective employed.

Hosiery clamping device 24 has a piston 34 and an article engaging plate 36 which is selectively moved through the use of a hydraulic cylinder 38. The frame 40 (FIG. 2) is designed to allow adjustment for the height of the clamping device 24 as well as the positioning of trimmer 30.

Any number of trimming devices may be used to effect the trimming and removal of loose yarn ends including severing or burning elements. It is also possible to keep the conveyor 14 stationary and move trimmer 30 into engagement with the loose yarn ends of article 16.

Thus, it can be seen that the deficiencies and disadvantages of prior art procedures have been eliminated in the present inventive concept. With respect to the above description, it is to be realized that the optimum dimensional relationships for the parts of the invention, to include variations in size, materials, shape, form, function, and manner of operation, assembly and use, are deemed readily apparent and obvious to one skilled in the art, and all equivalent relationships to those illustrated in the drawings and described in the specification are intended to be encompassed herein.

Therefore, the foregoing is considered as illustrative only of the principles of the invention. Further, since numerous modifications and changes will readily occur to those skilled in the art, it is not desired to limit the invention to the exact construction and operation shown and described. All suitable modifications and equivalents that fall within the scope of the appended claims are deemed within the present inventive concept.

What is claimed is:

1. Hosiery trimming apparatus for trimming and removing loose yarn ends from articles of hosiery comprising: a frame; a bidirectional conveyor supported by the frame receiving one or more articles of hosiery having loose yarn ends and moving the articles of hosiery in a first preselected direction; a first sensing means carried by the frame adjacent the conveyor; reversing means operable with the conveyor and activated by the first sensing means to reverse the directional movement of the conveyor and carried hosiery; a second sensing means carried by the frame adjacent the conveyor; hosiery article clamping and conveyor pivoting means activated by the proximity of the carried hosiery articles; yarn trimming means carried by the frame and operable upon activation by the second sensing means to trim the loose yarn ends from the hosiery articles when the articles are clamped and the conveyor is pivoted; and means associated with the hosiery article clamping and pivoting means returning the conveyor to its original position after completion of the trimming operation and returning the conveyor to movement in the first preselected direction whereby the trimmed hosiery articles are moved by the conveyor to a remote location.

2. The apparatus as claimed in claim 1 wherein said hosiery article clamping and conveyor pivoting means includes means elevating said conveyor and carried hosiery articles.

3. The apparatus as claimed in claim 1 wherein said hosiery article clamping and conveyor pivoting means includes means lowering said conveyor and carried hosiery articles.

4. The apparatus as claimed in claim 1 wherein said hosiery article clamping and conveyor pivoting means includes a hydraulic cylinder.

5. The apparatus as claimed in claim 1 wherein said yarn trimming means includes a burning element.

6. The apparatus as claimed in claim 1 wherein said yarn trimming means includes a severing device.

7. The apparatus as claimed in claim 2 wherein said hosiery article clamping and conveyor pivoting means includes a hydraulic cylinder.

8. The apparatus as claimed in claim 2 wherein said yarn trimming means includes a burning element.

9. The apparatus as claimed in claim 2 wherein said yarn trimming means includes a severing element.

10. The apparatus as claimed in claim 3 wherein said hosiery article clamping and conveyor pivoting means includes a hydraulic cylinder.

11. The apparatus as claimed in claim 3 wherein said yarn trimming means includes a burning element.

12. The apparatus as claimed in claim 3 wherein said yarn trimming means includes a severing element.

13. The apparatus as claimed in claim 4 wherein said yarn trimming means includes a burning element.

14. The apparatus as claimed in claim 4 wherein said yarn trimming means includes a severing element.

* * * * *